United States Patent [19]

Kirkup

[11] 4,092,623

[45] May 30, 1978

[54] CIRCUIT BREAKER

[75] Inventor: Joseph F. Kirkup, Parma, Mich.

[73] Assignee: Mechanical Products, Jackson, Mich.

[21] Appl. No.: 707,240

[22] Filed: Jul. 21, 1976

[51] Int. Cl.[2] ..... H01H 71/16

[52] U.S. Cl. ..... 337/66; 337/70

[58] Field of Search ..... 337/66, 68, 64, 70, 337/72, 74, 76

[56] References Cited

U.S. PATENT DOCUMENTS

| | | | |
|---|---|---|---|
| 3,031,542 | 4/1962 | Ellenberger | 337/66 |
| 3,451,016 | 6/1969 | Ellenberger | 337/66 |
| 3,456,225 | 7/1969 | Ellenberger | 337/66 |
| 3,551,867 | 12/1970 | Ingwersen | 337/66 |
| 3,708,776 | 1/1973 | Ellenberger | 337/66 |

*Primary Examiner*—Harold Broome

*Attorney, Agent, or Firm*—Harness, Dickey & Pierce

[57] ABSTRACT

A two pole circuit breaker is assembled in a case comprising two identical halves. Each case half contains one pole comprising like terminals and contacts. An actuating mechanism for both poles of the circuit breaker is mounted on the center line of the case so as to be clamped by the two case halves. The case halves also hold the external terminals and support the conductors and contacts of each pole of the circuit breaker. Bimetallic elements are secured to one of the terminals of each pole, bridging members containing contacts at opposite ends thereof, completing a circuit between the other of the terminals on each pole and the bimetal thereof when the contacts are in the closed condition. When an overload heats one or both of the bimetals, the bridging member is released, opening both contacts thereon and advancing a common trip bar of the operating mechanism to interrupt the circuit through the other pole. By pushing the manual operator inwardly, the contacts of both poles are reset. When the push button is advertently held in the "on" position, the circuit breaker is "trip free."

3 Claims, 10 Drawing Figures

FIG. 1.
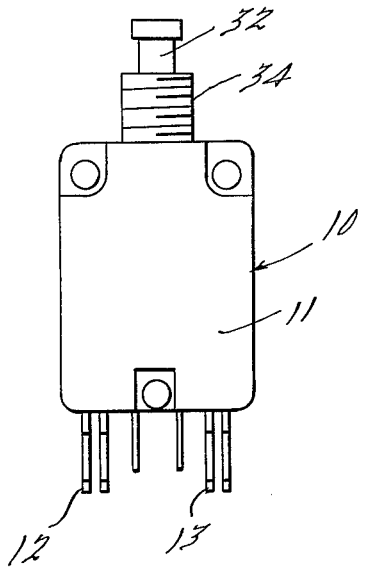
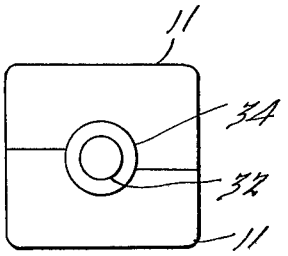
FIG. 2.
FIG. 3.
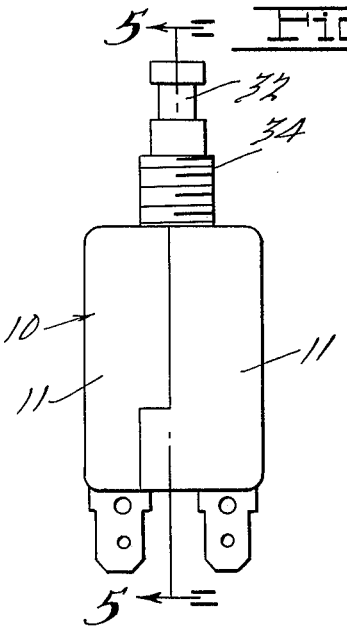
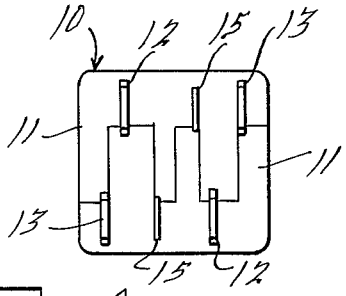
FIG. 4.

CIRCUIT BREAKER

BACKGROUND OF THE INVENTION

Reference may be had to the following U.S. patents which indicate the state of the art of two pole circuit breakers: U.S. Pat. Nos. 1,233,062; 2,745,922; 2,952,757; 3,451,016; 2,625,625; 2,895,028; 3,171,919; 3,559,139.

SUMMARY OF THE INVENTION

The invention relates to a novel combination operating spring and bridging member for a two pole circuit breaker. The bridging member has contacts at each end for engagement with a fixed contact and a latching contact on a bimetallic element, respectively. Heating of the bimetallic element releases its associated bridging member which in turn moves under its self-bias to an open condition as well as moving a transverse common trip bar so as to release the bridging member of the adjacent pole to open the circuit therethrough. By pushing inwardly on a manual operator, the contacts on the bridging member are biased into engagement with the contacts on its associated terminal and with the contact on the bimetallic element to complete a circuit through the pole.

BRIEF DESCRIPTION OF THE DRAWINGS

FIG. 1 is a view in elevation of a two pole circuit breaker embodying features of the present invention;

FIG. 2 is a plan view of the structure illustrated in FIG. 1;

FIG. 3 is a side view of the structure illustrated in FIG. 1;

FIG. 4 is a bottom view of the structure illustrated in FIG. 1;

DESCRIPTION OF THE PREFERRED EMBODIMENT

Figure 5:
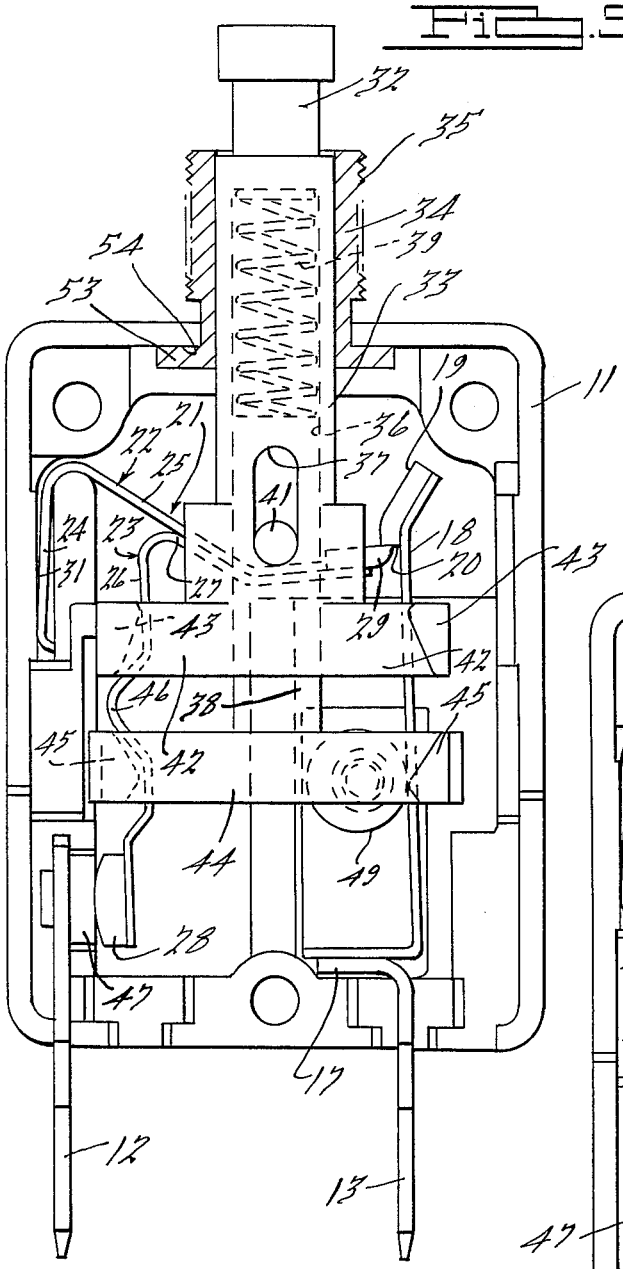
FIG. 5 is an enlarged sectional view of the structure illustrated in FIG. 3, taken on the line 5—5 thereof with the illustrated pole in closed position.

In FIGS. 1 to 4, a circuit breaker 10 comprises two identical halves 11 with the bottom end of each half having terminals 12 and 13 for each pole of the circuit breaker. The terminals 12 and 13 extend outwardly from the bottom of the case halves 11 from a point inside of its hollow interior and are retained in position thereby when they are secured together. For purposes of simplicity, only one pole will be described, it being understood that a duplicate pole is mounted in a duplicate case half 11.

As best seen in FIGS. 5 through 8, an inner end 17 on the terminal 13 supports one end of a bimetallic element 18. The bimetallic element 18 has a latching contact 19 on its inner end with a latching surface 20 extending at a right angle to the element 18.

A current-carrying bridging member, generally designated by the numeral 21, comprises a supporting spring element 22 and a contact-carrying element 23. Both of the elements 22 and 23 are made from conductive spring material, the element 22 having legs 24 and 25 and the element 23 having legs 26 and 27 disposed in angular relation to each other. The legs 25 and 27 of the elements 22 and 23 are secured together as by welding.

The ends of the legs 26 and 27 of the element 23 have contacts 28 and 29 attached thereto, the contact 28 being engageable with a fixed contact 47 on the terminal 12 and the contact 29 being engageable with the contact 19 on the bimetallic element in mechanical latching, as well as electrical engagement. The leg 24 of the of the supporting element 22 is disposed in a downwardly extending slot 31 in the upper edge of the case half 11. The legs 24 and 25 are formed and thereafter constrained to provide a counterclockwise bias to the element 23 about the fixed leg 24 of the element 22.

A manual operator or push button 32 has a stem 33 extending inwardly into the case 11 through a collar 34. The collar 34 is clamped between the two case halves 11, an outer thread 35 facilitating attachment of the circuit breaker 10 in an aperture in, for example, a mounting panel.

The stem 33 has an axial bore 36 extending therethrough for acceptance of a common trip shaft 38 as will be described. The stem 33 also has a radial, axially elongated slot 37 therein for the acceptance of a common trip pin 41, as will be described.

The common trip shaft 38 is telescopically accepted in the axial bore 36 of the stem 33. A spring 39 between the end of the shaft 38 and the top of the bore 36 serves to bias the shaft 38 downwardly relative to the stem 33. The common trip shaft 38 carries the common trip pin 41 which extends through the slot 37 in the stem 33. The pin 41 extends radially outwardly from the common trip shaft 38 and is freely movable longitudinally within the slot 37.

Attached to the lower end of the stem 33 is a transversely disposed bar 42 with cam-like elements 43 extending laterally therefrom in opposite directions at the ends thereof. Similarly, attached to the lower end of the common trip shaft 38 is a transversely disposed bar 44 having cam-like elements 45 extending laterally therefrom in opposite directions at the ends thereof.

Figure 6:
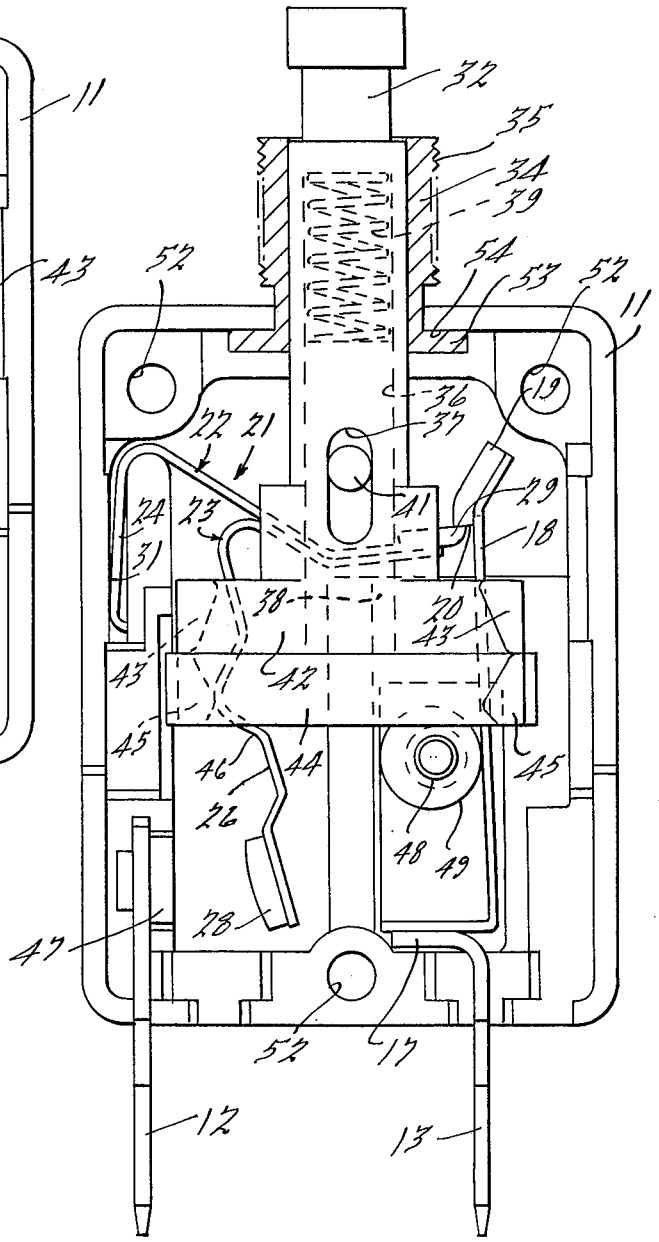
FIG. 6 is a view similar to FIG. 5 showing one pole in the trip-free condition.
Figure 7:
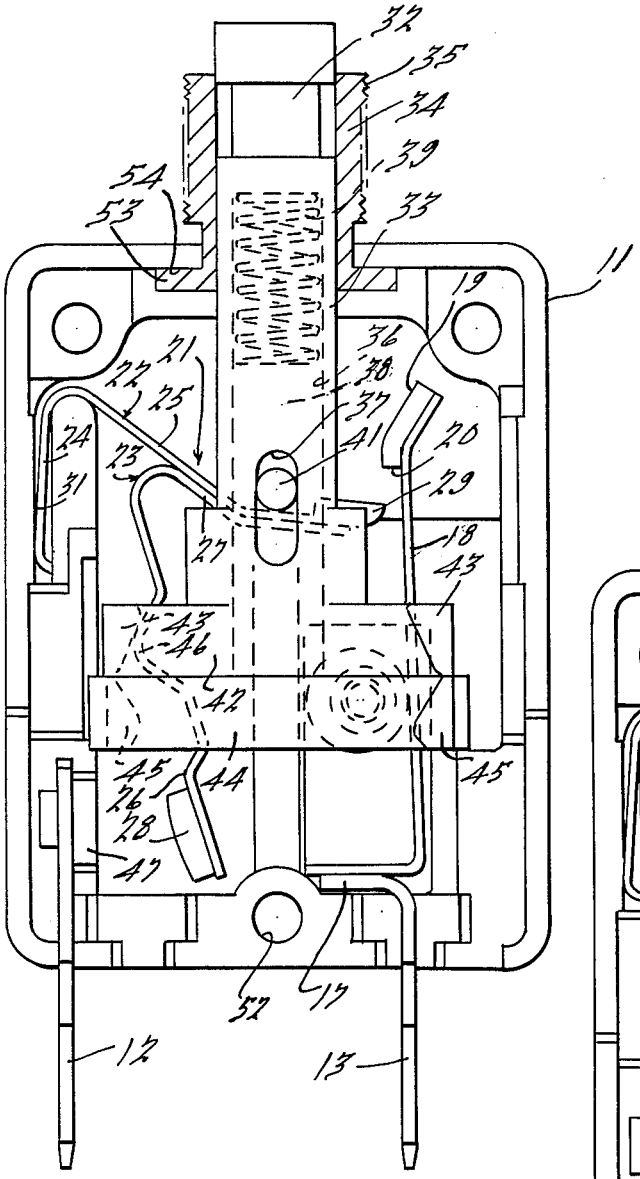
FIG. 7 is a view similar to FIG. 5, showing the circuit breaker pole in the reset position.
Figure 8:
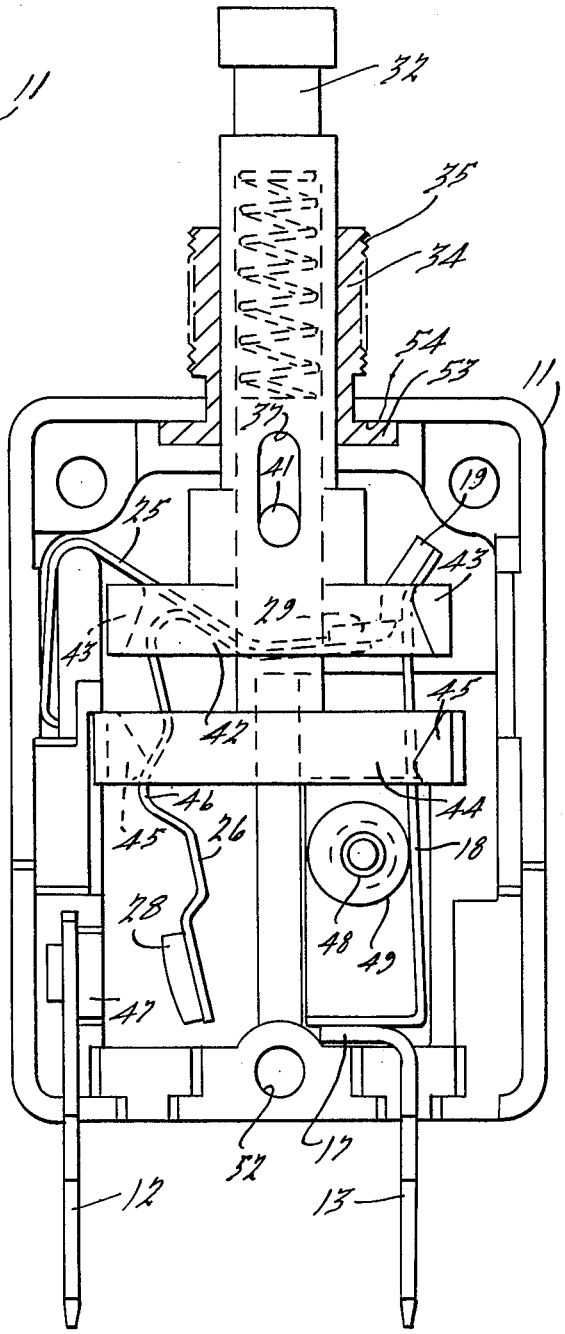
FIG. 8 is a view similar to FIG. 5, showing the circuit breaker pole in the manually actuated "open" condition.

The leg 26 of the bridging member 21 that extends generally parallel to the shaft 38 has an arcuate camming portion 46 provided thereon which is in position to be engaged by the cam-like elements 43 and 45 to move the leg 26 inwardly toward the stem 33 thereby biasing the contact 28 out of engagement with the contact 47 to interrupt the circuit between the terminals 12 and 13, as illustrated in FIGS. 6–8.

As best seen in FIG. 7, the push button 32 has been pushed into the case 11 for resetting the contacts 28 and 29 of the bridging member 21. Downward movement of the push button 32 on the stem 33 brings the bar 42 thereon into engagement with the common trip bar 44 on the common trip shaft 38. The pin 41 on the common trip shaft 38 engages the legs 25 and 27 of the bridging member 21 and moves them and the contact 29 downwardly. Concommitently the cam member 43 on the bar 42 of the stem 33 engages the camming portion 46 of the leg 26 to insure that the contact 28 is maintained out of engagement with the contact 47. This operating feature satisfies the requirement that it be impossible to have a completed circuit through the circuit breaker 10 in the presence of an overload or fault regardless of the position of the manual operator 32. Release of the manual operator 32 permits the contact 29 to engage the shoulder or latching face 20 on the contact 19 and permits the bias of the leg 26 of the bridging member 21 to carry the contact 28 into engagement with the contact 47.

A screw 48, having an eccentric cam ring 49 thereon, is attached to each case half 11 with the cam ring 49 in engagement with the bimetallic element 18. Rotation of the screw 48 and the cam rim 49 effects caliberation of the element 18. The cam ring 49 is formed of insulating material and is in engagement with the bimetallic element 18 in such a manner as to limit its inward movement, thereby defining the latch overlap between the contacts 19 and 29.

The second pole of the circuit breaker is identically constructed with the pole heretofore described and disposed within a case half 11 in the same manner. Both poles share in common the manual operator 32, stem 33, collar 34, common trip shaft 38, pin 41 and bars 42 and 44, as best seen in FIGS. 5 through 8.

After the assembly of each circuit breaker pole in its case half 11, the manual operator 32 and its associated mechanism is mounted in the center between the two case halves. Rivets are inserted in aligned apertures 52 through the case halves to secure the two case halves to each other. A flange 53 on the collar 34 extends within a slot 54 in each half of the case to further insure structural integrity of the assembly.

In FIG. 5, the one pole of the circuit breaker is shown with both contacts 28 and 29 in closed position, completing a circuit through the terminals 12 and 13.

Figure 9:
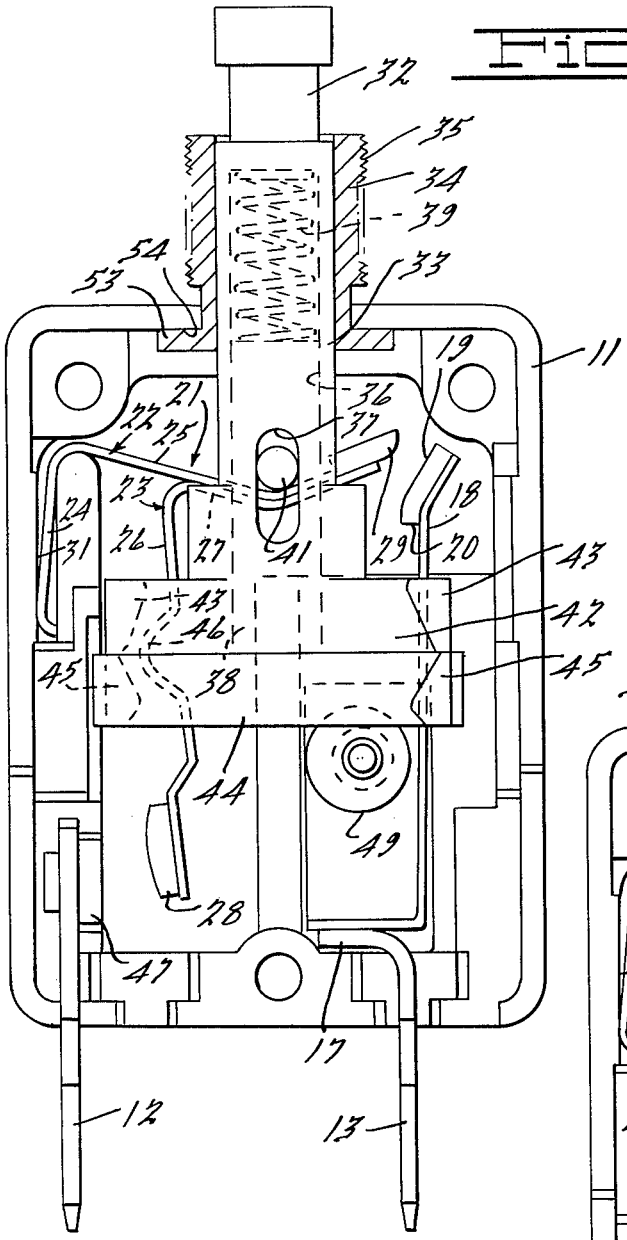
FIG. 9 is a view similar to FIG. 5 showing one pole in the trip-free, electrically opened condition.

FIG. 6 shows "trip free" operation notwithstanding the fact that the manual operator 32 is held in the closed position. Upward movement of the leg 22 of the bridging member 21 upon the occurrence of an electrical overload sufficient to effect movement of the bimetal 18 to the unlatched condition, moves the pin 41 on the common trip shaft 38 upwardly therewith, thereby moving the common trip cross bar 44 upwardly. Under normal conditions, the manual operator 32 will extend to the positions shown. The cam 45 on the common trip crossbar 44 engages the camming portion 46 on the leg 26 of the bridging member 21 of the pole not electrically tripped, mechanically opening the contact 28 thereof. FIG. 9 illustrates the electrically tripped side of the circuit breaker.

In FIG. 7, the manual operator 32 is shown in the reset position which moves the contact 29 downwardly under the bias of the pin 41 to condition it for reengagement with the contact 19 on the bimetallic strip 18 to reset the circuit breaker. Concommitently, the cam 43 on the bar 42 engages the lobe 46 on the bridging member 21 to bias the contact 28 out of engagement with the fixed contact 47 conditioning the circuit breaker 10 for closing.

Upon release of the manual operator 32, the cam element 43 of the bar 42 moves from engagement with the camming portion 46 permitting the contact 28 to engage the contact 47 and the latching contact 29 to engage the contact 19.

In FIG. 8, the manual operator 32 is shown pulled out to effect manual opening of the circuit breaker 10. Upon upward movement of the bar 44, the insulating cam 45 thereon engages the camming portion 46 of the strip 26 and thereby moves the contact 28 out of engagement with the contact 47 to open the circuit breaker.

To close the circuit breaker 10, inward movement of the manual operator 32 moves the trip bar 44 downwardly which releases the leg 26 of the bridging member 21 and permits the contact 28 thereon to engage the contact 47 due to the self-bias in the bridging member 21.

As shown in FIG. 9, the circuit breaker 10 is in the trip free, electrically open condition.

Figure 10:
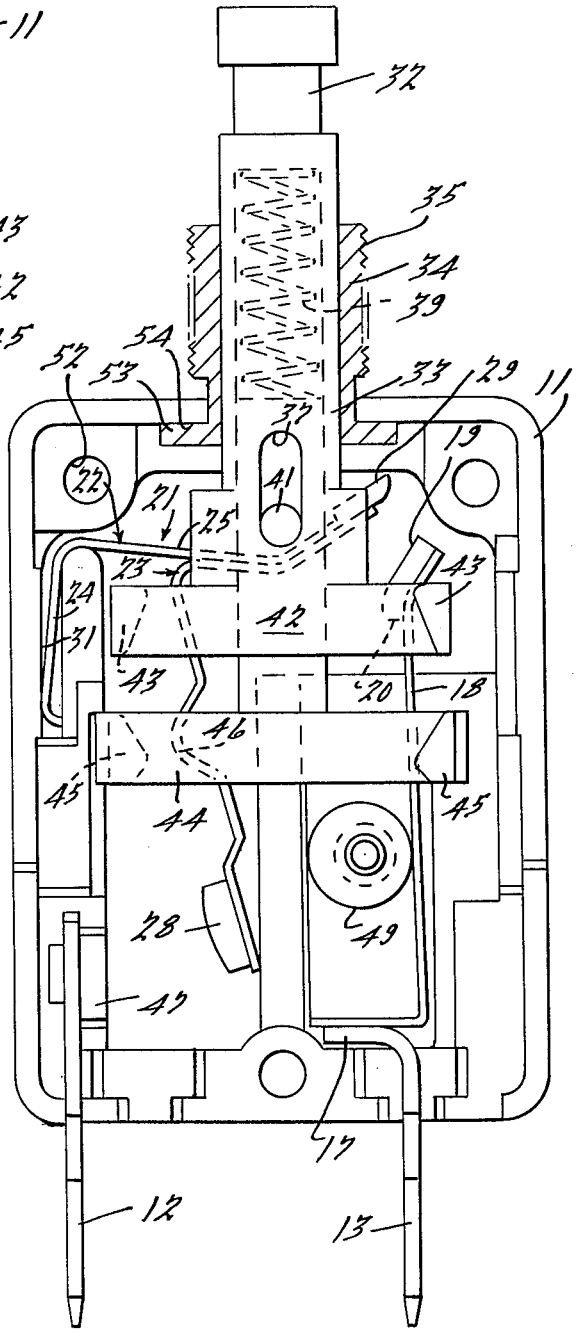
FIG. 10 is a view similar to FIG. 5 with one pole in the normal, electrically opened condition.

As seen in FIG. 10, upward movement of the leg 22 of the bridging member 21 upon the occurrence of an electrical overload sufficient to effect movement of the bimetal 18 to the unlatched condition, moves the pin 41 on the common trip shaft 38 upwardly therewith, thereby moving the common trip cross bar 44 upwardly. Under normal conditions, this manual operator 32 will extend to the positions shown under the bias of the spring 39.

It is to be understood that the mechanism described hereinabove may be used to construct a single pole circuit breaker, the arrangement being such that, for example, one case half and a closure panel could be used. Thus, the features herein employed may be used on a circuit breaker of a single or multiple pole type.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. A circuit breaker comprising a case molded from insulating material, spaced terminals extending through the case to the interior thereof, a contact on the inner end of one of said terminals, a bimetallic element having one end attached to the inner end of the other terminal, a latching contact on the opposite end of said bimetallic element, and a unitary resilient conductive bridging member comprising a mounting arm and two contact arms angularly related to one another, one of said contact arms having a pressure contact on the end thereof, the other of said contact arms having a latchable contact at the end thereof, said pressure and latchable contacts being engageable and latchable with the contacts on said one terminal and said bimetallic element, respectively, the mounting arm of said bridging member having an end portion rigidly mounted in said case, said bridging member being self-biased for rotation in one direction to maintain contact pressure between the latchable contact on said other contact arm and the latching contact on said bimetallic element when said circuit breaker is in the closed condition, said one contact arm having a self-bias to maintain contact pressure between the pressure contact thereon and the contact on said one terminal, the self-bias of said mounting arm effecting separation of the pressure and latchable contacts on said one and other contact arms from the contacts on said one terminal and bimetallic element, respectively, upon the occurrence of an overload in a circuit containing said circuit breaker.

2. A circuit breaker in accordance with claim 1, including a manual operator slidably mounted in said case for moving the latchable contact on the one contact arm of said bridging member against the self-bias of the mounting arm thereof towards the closed condition relative to the latching contact on said bimetallic element.

3. A circuit breaker in accordance with claim 1, wherein said manual operator includes a cam engageable with said one contact arm to move it against its self-bias to the open condition relative to the pressure contact on said one terminal upon movement of said manual operator to the closed condition.

* * * * *